US008112957B2

(12) United States Patent
Hillers

(10) Patent No.: US 8,112,957 B2
(45) Date of Patent: Feb. 14, 2012

(54) BUILDING COMPONENT BASED ON A PLASTIC FOAM MATERIAL

(76) Inventor: Guillaum Eugene Hillers, Vlaardingen (NL)

( * ) Notice: Subject to any disclaimer, the term of this patent is extended or adjusted under 35 U.S.C. 154(b) by 1467 days.

(21) Appl. No.: 11/570,272

(22) PCT Filed: Jun. 11, 2004

(86) PCT No.: PCT/NL2004/000417

§ 371 (c)(1),
(2), (4) Date: Dec. 8, 2006

(87) PCT Pub. No.: WO2005/121469

PCT Pub. Date: Dec. 22, 2005

(65) Prior Publication Data

US 2008/0034695 A1 Feb. 14, 2008

(51) Int. Cl.
*E04C 1/00* (2006.01)

(52) U.S. Cl. ..... 52/309.7; 52/268; 52/309.16; 52/404.2; 52/794.1

(58) Field of Classification Search ..... 52/309.7, 52/309.13–309.17, 268, 405.3, 407.1, 309.1, 52/309.4, 309.6–309.11, 404.2, 794.1
See application file for complete search history.

(56) References Cited

U.S. PATENT DOCUMENTS

| | | | | |
|---|---|---|---|---|
| 3,305,991 | A * | 2/1967 | Weismann | 52/309.11 |
| 3,496,058 | A * | 2/1970 | Ross et al. | 428/160 |
| 6,272,805 | B1 * | 8/2001 | Ritter et al. | 52/309.11 |
| 2003/0090016 | A1 * | 5/2003 | Petrovic et al. | 264/31 |

FOREIGN PATENT DOCUMENTS

| | | | |
|---|---|---|---|
| EP | 0425057 | A | 5/1991 |
| EP | 0703330 | A | 3/1996 |
| JP | 07052297 | A | 2/1995 |

* cited by examiner

*Primary Examiner* — William Gilbert
(74) *Attorney, Agent, or Firm* — Laubscher & Laubscher, P.C.

(57) ABSTRACT

The invention concerns a building component that is assembled from a plastic foam material and a reinforcement netting of a spatial structure being at least partly embedded in the foam material, in which the plastic foam material is provided with a layer of sand at the side where the reinforcement netting projects from the foam material. The individual grains of the layer of sand are mutually connected to a binding agent to be applied in a liquid state, in which directly connecting to the layer of sand, the foam material is formed with the same binding agent.

16 Claims, 1 Drawing Sheet

BUILDING COMPONENT BASED ON A PLASTIC FOAM MATERIAL

BACKGROUND OF THE INVENTION

The present invention relates to a building component assembled from a plastic foam material and a reinforcement netting of a spatial structure being at least partly embedded in the foam material.

BRIEF DESCRIPTION OF THE PRIOR ART

Such a building component is known from European patent EP-B1-0 425 057 in which it is applied as a cladding unit which is fixed to the outside of a supporting structure and is intended for being finished with a coat of plaster. The invention aims to provide for a building component having strongly improved properties in relation to said known building component.

SUMMARY OF THE INVENTION

Accordingly, the invention provides for, that the plastic foam material is provided with a layer of sand at least at the side where the reinforcement netting projects from the foam material. Further, it has been provided for that individual grains of the layer of sand are adhered to one another with a binding agent and that the layer of sand is adhered to the foam material with the same binding agent.

The most important advantage obtained by this is that the mechanical properties have been improved in such a way that the building component can not only by used as e.g. a cladding unit, that is, as a finishing component that is to be applied against a supporting structure, but that the building component can also be used as a constructional element. For example, it is possible without any difficulty, to use the building component as floor a element onto which a hard finishing layer is applied, such as concrete, for example. The initial supporting strength of a building component according to the invention is amply sufficient for being able to be put on a supporting structure of spaced apart supporting elements, such as e.g. supporting beams.

Apart from strength and stiffness, the applied layer of sand on the building component also provides for that damages at this side of the building component are nearly excluded. Further, this means that on use as a wall component, behind an applied finishing layer such as e.g. a coat of plaster, there is a hard layer being able to offer sufficient support to fastening means of objects such as e.g. wall closets, mirrors, paintings and other furniture or decorations to be secured to the wall. Such fastening means will mostly comprise a fastening plug which is able to engage the layer of sand extremely well.

A further advantage of the layer of sand is that the relief and thereby the larger surface of this layer gives a better adhesion of a further layer to be applied thereon. Better adhesion on application as a floor element also means that the distribution of forces exerted on a layer applied thereon, such as e.g. a layer of concrete, will be more uniform.

According to another development, a special reinforcement netting is provided having one or more reinforcement wires extending in a first and second direction, in which approximately inverted U-shaped portions have been made. Preferably, it has been provided for, that a first and a second reinforcement wire have been applied both extending in the first direction and both being provided with parts in such a way that spaced-apart, approximately inverted U-shaped parts project from the building component, in which the inverted U-shaped parts in the first and second reinforcement wires are in alignment in a second direction transverse to the first direction.

According to yet another embodiment, the inverted U-shaped parts in the first and second reinforcement wires are of unequal dimensions, in which the inverted U-shaped parts in the second reinforcement wire, where they project from the building component, when seen in the first direction, have a length of 2 to 3 times the length of the inverted U-shaped parts in the first reinforcement wire where they project from the building component. Thus, it is achieved that a major part of the length of the reinforcement wires is embedded in the foam material, properly engaging it.

Preferably, the centers of the inverted U-shaped parts in the first and second reinforcement wires are situated at mutually parallel lines, the lines extending in the second direction. By this alignment of the inverted U-shaped parts, parallel free paths are provided between them, which can serve for accommodating conduit systems therein. The conduits can be gas, electricity and water conduits, but also heating conduits, in which these can be used in both wall and floor elements. Finally, the difference in size of the inverted U-shaped parts produces an offset as a result of which besides the forces in the first and second directions, the forces across an angle to the directions can also be distributed more evenly.

For a mutual connection between the first and second reinforcement wires, a third and a fourth reinforcement wire, respectively, have been provided, connecting the centers of the aligned inverted U-shaped parts and connecting the centers of the further parts of the first and second reinforcement wires situated between the inverted U-shaped parts.

Finally, a fifth reinforcement wire is provided, extending in the second direction and connecting at least subsequent third reinforcement wires. Preferably, the fifth reinforcement wire is mounted in the middle between subsequent first and second reinforcement wires.

The reinforcement netting thus obtained is extremely well anchored in the foam material, provides for additional strength and stiffness of the building component and offers space for mounting conduit systems. Further, by its relatively fine-mesh structure the reinforcement netting additionally offers a further point of engagement for fastening plugs, more in particular for wing plugs and comparable fastening plugs.

The invention also provides a method for manufacturing a building component, the method comprising at least the following steps:

- positioning a reinforcement netting into a template;
- applying a layer of sand in the template up to a desired level in relation to the reinforcement netting;
- applying a binding agent on the layer of sand; and
- subsequently foaming up to a predetermined level or up to the edge of the template with a plastic foam material.

Preferably, the binding agent by which the gains of sand are mutually connected is formed by the liquid compound of which the foam material is formed.

According to a further development, the binding agent is a polyurethane compound which is applied onto the layer of sand in a liquid state and will be partly absorbed in the layer of sand. The foam material is formed by the part of the polyurethane compound which will not be absorbed in the layer of sand. The great advantage with using the same compound as both binding agent and foam material is that a continuous transition from a liquid compound cured in the layer of sand to a foam material formed of the same compound will be produced as a result of which an optimum adherence of a particularly hard layer of sand to the foam material will be provided.

The sand used for the layer of sand should be sufficiently dry for being able to accommodate the binding agent between the grains. In order to bind no more than a predetermined layer thickness of the sand put in the template, the grain size of the grains of sand should not be too large. In case of a grain size which is too large or a large difference in grain sizes, the binding agent could be entirely absorbed in the layer of sand put in the template, or a strongly varying layer thickness of adhered grains of sand could arise. Further, it is important that the grains of sand show a relatively dense stacking, which can be effected by vibrating the sand put in the template. The composition of the layer of sand and the degree to which the sand has been dried are also important for obtaining a proper adherence with a finishing layer or concrete layer to be applied on it.

In a number of tests, satisfying results have been achieved with sand substantially comprising fine sand having a mean grain size of 100-225 μm that was fire-dried preceding use. This can produce the desired thickness of the layer of sand, which is preferably between 1-10 mm, and more preferably between 2-6 mm.

The template used for manufacturing the building component is made in the desired shape of the building component and can be a template being open or sealable at the top into which the polyurethane compound is dosed in a controlled manner. After partly or completely curing of the binding agent and the foam material, the building component can be released from the template, in which the non-bound portion of the layer of sand is separated from the bound portion of the layer of sand. The separation can be improved by vibrating the template and/or after blowing clean the top surface of the building component. The remaining part of the sand can be used again for filling the template to a predetermined level for manufacturing the next building component.

BRIEF DESCRIPTION OF THE FIGURES

Hereinbelow, the invention is further explained by way of the example given in the drawing, in which.

DETAILED DESCRIPTION

Figure 1:
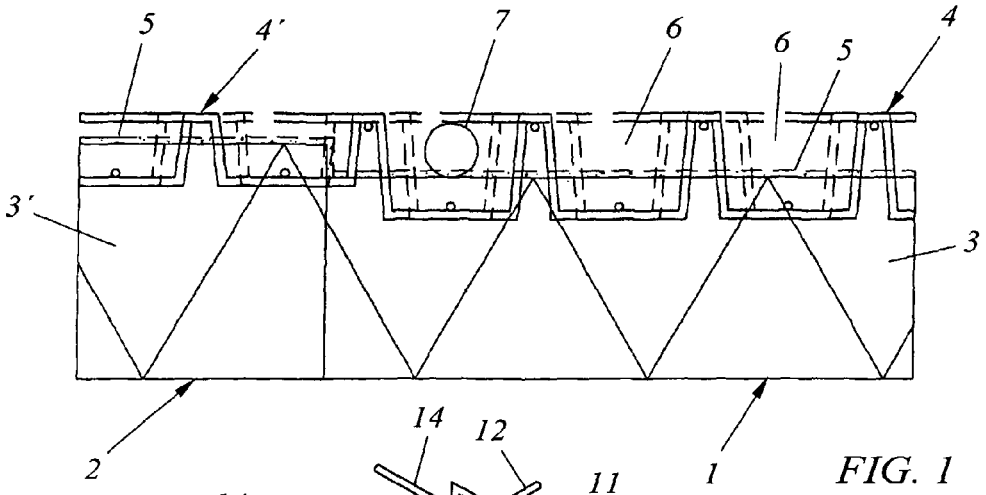
FIG. 1 shows a cross-section of a floor or wall element and a cladding unit.

FIG. 1 shows two building components 1, 2 in cross-section, both substantially comprising a plastic foam material 3, such as a polyurethane foam, a reinforcement netting 4, 4' embedded in the foam material 3 and a layer of sand 5 directly connected to the foam material 2, 3'. The individual grains of sand of the layer of sand 5 are bound with the polyurethane compound which produces the foam material.

The building component 1 is intended for indoor use as e.g. floor element or wall element and distinguishes itself substantially from constructing element 2, which is meant for being used as a cladding unit, by a reinforcement netting 4 projecting higher above foam material 3 and layer of sand 5. The reinforcement netting 4 is assembled in such a way that it has continuous free zones 6, which are intended for accommodating conduit and/or duct systems 7. These can be electricity, water and/or gas conduits but may well be the conduits of a floor heating or wall heating system.

The building component 2 has a less high reinforcement netting 4' and a thicker layer of foam material 3', in which however, the total thickness of the building component 2 equals the thickness of the constructing element 1. The building component 2 is meant to be used at the outside as a cladding unit, in which a higher isolation value by the thicker foam layer 3' is desirable and in which the possibility to incorporate a conduit system is not considered.

Figure 2:
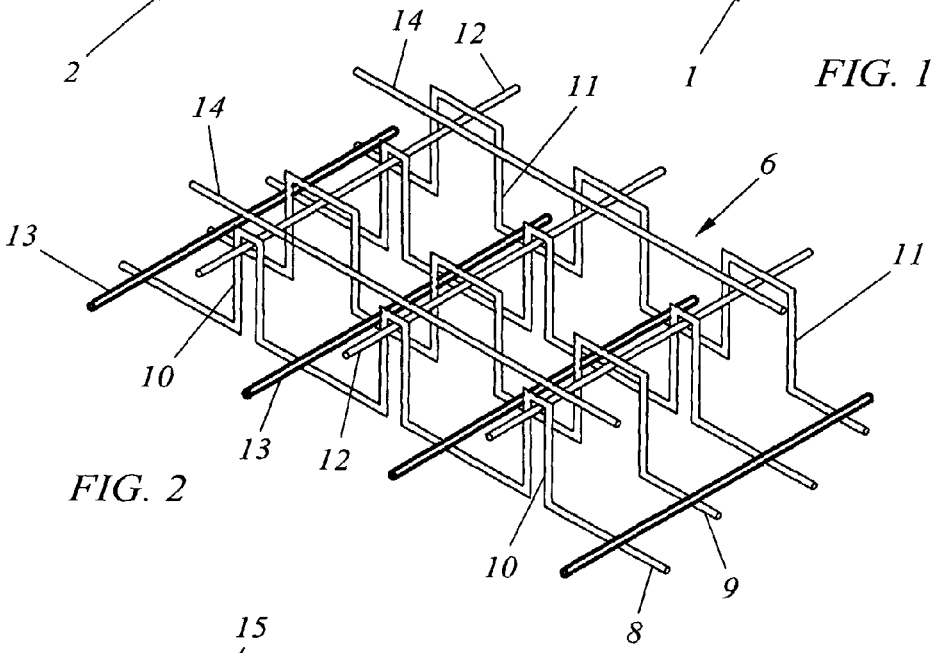
FIG. 2 shows a perspective view of a reinforcement netting incorporated in the building component.

FIG. 2 shows a reinforcement netting 4 in more detail. The reinforcement netting 4 is composed of first and second reinforcement wires 8, 9 in a first direction, each being provided with spaced-apart inverted U-shaped parts 10, 11. The inverted U-shaped parts 10, 11 have their axes in one line but have different widths. Between the subsequent rows of inverted U-shaped parts are the free zones 6 into which conduit and/or duct systems 7 can be incorporated.

The reinforcement netting 4 is further provided with third and fourth reinforcement wires 12, 13 extending in a second direction square to the first direction. The reinforcement wire 12 connects the mid-points of the inverted U-shaped parts 10, 11 to one another and the reinforcement wire 13 connects the mid-points of parts of the reinforcement wires 8, 9 lying between them. Finally, a fifth reinforcement wire 14 is provided, which is located transverse to the third reinforcement wire 12. The thus formed reinforcement netting gives more than enough strength and stiffness and contributes largely to the distribution of the forces exerted on the coat of plaster or layer of concrete applied on the building component.

Figure 3:
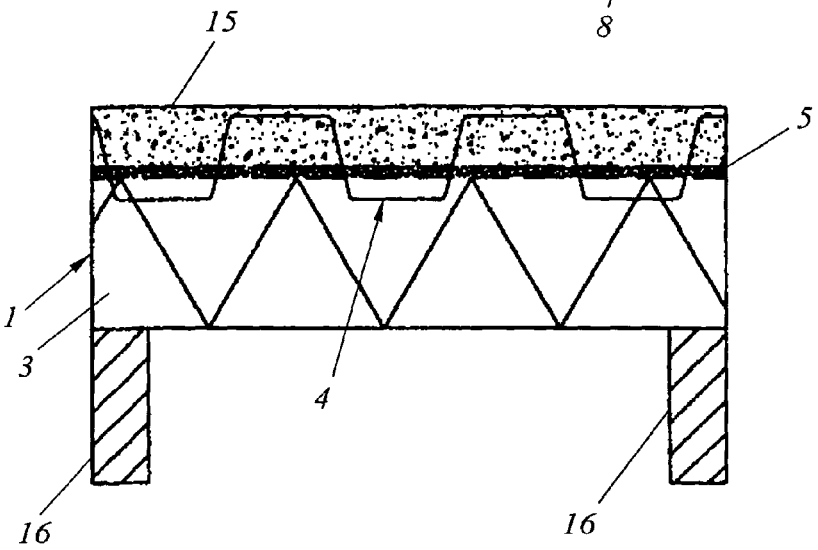
FIG. 3 shows a schematic use of the building component as floor element.

FIG. 3 shows schematically a cross-section of a building component 1 used as bearing floor element. The building component 1 has successively a layer of foam material 3, a layer of sand 5, a reinforcement netting 4 applied in the foam material 3 and the layer of sand 5, and a concrete layer 15 applied on the building component 1. There, the building component 1 is carried by supporting points 16 spaced-apart from one another, which is possible by the strongly improved mechanical properties of the building component 1, which were obtained by the layer of sand 5 applied thereon. The supporting points 16 can be e.g. spaced-apart wooden beams, but also be a steel or stone, or concrete supporting structure.

The invention claimed is:

1. A building component, comprising a layer of plastic foam material having first and second surfaces, a reinforcement netting of a spatial structure being at least partly embedded in a first surface of said foam material and terminating at different depths between said first and second surfaces, and a layer of sand provided on said foam material at least on said first surface where the reinforcement netting projects from said foam material.

2. A building component according to claim 1, wherein individual grains of the layer of sand are adhered to one another by a binding agent and the layer of sand is adhered to the foam material with the same binding agent.

3. A building component according to claim 2, wherein the binding agent is a polyurethane compound.

4. A building component according to claim 1, wherein the layer of sand has an irregular outer surface.

5. A building component according to claim 4, wherein the layer of sand has an approximately constant thickness across the entire first surface of the building component.

6. A building component according to claim 1, wherein the reinforcement netting comprises at least one reinforcement wire extending in a first direction, said wire including a plurality of spaced, approximately inverted U-shaped portions projecting from said building component.

7. A building component according to claim 6, wherein the reinforcement netting comprises a plurality of first and second reinforcement wires extending in the first direction and being provided with spaced inverted U-shaped portions which project from the building component, the inverted U-shaped portions in said first and second reinforcement wires being aligned in a second direction transverse to said first direction.

8. A building component according to claim 7, wherein the inverted U-shaped portions in said first and second reinforcement wires are of unequal dimensions, the inverted U-shaped portions in the second reinforcement wires where they project from the building component having a length of 2 to 3 times the length of the inverted U-shaped portions in the first reinforcement wires where they project from the building component.

9. A building component according to claim 8, wherein third and fourth reinforcement wires, respectively, are provided extending in said second direction and connecting the mid-points of the aligned inverted U-shaped portions and connecting the mid-points of the portions of said first and second reinforcement wires situated between said inverted U-shaped portions, respectively.

10. A building component according to claim 8, wherein a fifth reinforcement wire is provided, extending in the first direction and connecting at least said third reinforcement wires.

11. A building component according to claim 10, wherein the fifth reinforcement wire is mounted between said first and second reinforcement wires.

12. A building component according to claim 7, wherein the mid-points of the inverted U-shaped portions in the first and second reinforcement wires are situated on mutually parallel lines, said lines extending in said second direction.

13. A building component according to claim 7, wherein the thickness of the layer of sand is between 1-10 mm.

14. A building component according to claim 1, wherein the sand used for the layer of sand is dry sand substantially comprising fine sand having a mean grain size of 100-225 μm.

15. A building component according to claim 1, wherein the plastic foam material is a polyurethane foam material.

16. A structure including at least one building component according to claim 1, in which said building component is used as at least one of a constructing element and a finishing element.

* * * * *